United States Patent [19]

Huppmann

[11] Patent Number: 4,708,912

[45] Date of Patent: Nov. 24, 1987

[54] SINTERED METAL BODY WITH AT LEAST ONE TOOTHING

[75] Inventor: Winfried Huppmann, Radevormwald, Fed. Rep. of Germany

[73] Assignee: Sintermetallwerk Krebsoege GmgH, Radevormwald, Fed. Rep. of Germany

[21] Appl. No.: 867,156

[22] Filed: May 27, 1986

Related U.S. Application Data

[63] Continuation of Ser. No. 632,195, Jul. 18, 1984, abandoned.

[51] Int. Cl.[4] ..... B22F 3/02

[52] U.S. Cl. ..... 428/547; 419/28; 419/69; 29/159.2; 29/DIG. 31; 428/548

[58] Field of Search ..... 419/28, 69; 428/547, 428/548; 29/DIG. 31, 159.2

[56] References Cited

U.S. PATENT DOCUMENTS

| | | | |
|---|---|---|---|
| 2,763,519 | 9/1956 | Thomson | 428/547 X |
| 2,917,821 | 12/1959 | Fritsch | 419/28 |
| 3,772,935 | 11/1973 | Dunn et al. | 419/28 X |
| 3,867,751 | 2/1975 | Connell et al. | 419/28 X |
| 3,874,049 | 4/1975 | Ferguson | 419/28 X |
| 4,059,879 | 11/1977 | Chmura et al. | 419/2 X |
| 4,394,421 | 7/1983 | Chmura et al. | 428/547 |

FOREIGN PATENT DOCUMENTS

| | | | |
|---|---|---|---|
| 97027 | 12/1983 | European Pat. Off. | 419/28 |
| 2004455 | 10/1970 | Fed. Rep. of Germany | 419/28 |
| 142122 | 6/1980 | German Democratic Rep. | 428/547 |

OTHER PUBLICATIONS

Henderson, et al., *Metallurgical Dictionary,* "Forging", Reinhold Publishing Corp. NY, NY (1953), p. 141.

Hirschhorn, J. S., *Introduction to Powder Metallurgy,* Amer. Plud. Metallugy Inst., NY,NY, (1969), p. 291–292.

Eds., "Where Powder Metallungy is Growing", *Metal Progress,* Apr. 1971, p. 54–60.

Altemeyer, Stanley "Density/Ecnomy Relationships of P/M Parts", *Machine Design* 1972, pp. 72–76.

*Primary Examiner*—Matthew A. Thexton

*Attorney, Agent, or Firm*—Antonelli, Terry & Wands

[57] ABSTRACT

A sintered metal body with at least one toothing thereon and a method of forming the same. The toothing is formed in a sintered metal blank with or without pre-toothing by metal forming. The final toothing is cold rolled into the sintered metal blank. The thus formed sintered metal body with at least one toothing can be used for highly stressed toothed gears, such as involutes, cycloids, and epicycloids, as used, for example, on bevel gears, and particularly curved-toothed bevel gears.

4 Claims, 4 Drawing Figures

SINTERED METAL BODY WITH AT LEAST ONE TOOTHING

This is a continuation of application Ser. No. 632,195, filed July 18, 1984, and now abandoned.

BACKGROUND OF THE INVENTION

This invention relates to a sintered metal body with at least one toothing, the toothing being formed in a blank by metal forming with or without pre-toothing.

In DE-PS No. 2659733 a sintered metal body with at least one toothing is described, the toothing being formed in a blank by metal forming with or without pre-toothing. According to this process, toothed gears are manufactured with a profile shift which changes continuously and regularly from one front face of the toothing to the other front face with a beveled enveloped surface of the toothing.

For this purpose, a master gear is made by a cutting process, then from the master gear, using an image-forming manufacturing process, a die is manufactured. The toothing of a gear is produced by a shaping process in the die under heat in which a predetermined temperature at the end of the shaping process is strictly adhered to, and in which the contraction of and the modular change in the toothing upon the cooling down of the workpiece from the prescribed final temperature are compensated for by corresponding changes of the dimensions of the master gear. As a result, the toothed gear produced in the die is calibrated with nominal dimensions using a calibration die which is manufactured by an image-forming manufacturing process from a second master gear which is made by a cutting process. In the course of the manufacture of the toothed gear by a sintering process, the contraction of and the modular change in the toothing during sintering and cooling down of the workpiece are corrected by corresponding changes in the dimensions of the master gear.

According to the process described above, including forging a toothed gear using an initial master gear and a die made from the initial master gear, considering the contraction of and the modular change in the toothing, and calibrating the toothed gear in a calibrating die made from a second master gear, which deviates from the initial master gear it is possible to manufacture gears with a cylindrical rolled surface for gearing with a high degree of precision when the dies have good tool-life. This process involves very high costs of production, and is likely to be employed only in special cases.

The U.S. patent to Dunn et al, U.S. Pat. No. 3,772,935, describes a process for forming a toothing in a blank made of sintered metal material by metal forming (see in particular FIGS. 5 and 6). This process uses a type of stamping tool to press the material into a form in order to produce the workpiece. The teeth require a finish machining process, such as, grinding or cutting.

According to a procedure described in "Machine Design", 1972, pp 72–76, a final toothing is achieved from a pre-toothed sintered metal blank by one or more metal forming processes.

SUMMARY OF THE INVENTION

The present invention has among its objects the production of a toothed gear, which is capable of withstanding high degrees of stress, by forming a sintered metal body with at least one toothing in a blank with or without pre-toothing. The sintered metal body and the toothing thereon are not subject to the strength limitations existing in toothed gears manufactured by powder-metallurgical processes, for example. The tooth geometry of the gears of the present invention is of practically no significance.

The object of the invention is achieved by a method in which two rolling tools provided with teeth extending substantially parallel to the axis of a sintered metal blank are arranged at opposite radial sides of the sintered metal blank, at least one of the rolling tools is moved radially toward the other rolling tool and therefore toward the sintered metal blank so that the teeth of the rolling tools penetrate into the sintered metal blank, and the at least one rolling tool is rotated about its axis so that the sintered metal blank is rotated by frictional resistance and a final toothing is formed in the sintered metal blank by cold rolling.

Because of the known properties of tooth gears manufactured by powder-metallurgical processes, it has apparently been the opinion of professionals that highly stressed gears, such as those used in gear boxes of automobiles, could be manufactured only by conventional processes, such as a cutting and/or grinding process, particularly since the cold forming of toothings in solid blanks had proved to be unsatisfactory.

However, it has been unexpectedly discovered by the present invention that by starting from a blank made of sintered material, a desired toothing can be manufactured by rolling the toothing into the sintered metal blank. This method can be used for forming the tooth forms usually used for highly stressed toothed gears, such as involutes, cycloids, and epicycloids, as used on bevel gears and the like, and particularly curved tooth bevel gears.

In accordance with the present invention, it has been unexpectedly discovered that, because of the space which can be filled within the sintered material blanks, it is possible to displace the material itself and form the toothing into the blank. This displacement produces hardening in the region of the teeth, which is of great advantage particularly for highly stressed toothed gears. It has been discovered that the strength of rolled blanks of teeth and the dedendum of toothed pinions used for gear boxes of automobiles and made in accordance with the present invention are fully comparable to those of toothed gears manufactured by conventional toothing processes. Thus, the strength limitations of gears manufactured by previously known powder-metallurgical processes do not occur in gears manufactured in accordance with the present invention.

Further, the toothed geometry is of practically no significance in the process of the present invention, so that the relevant limitation of gears manufactured by previously known powder-metallurgical processes does not occur in gears manufactured in accordance with the present invention.

It has been found that not only can toothed gears, such as pinions, cylindrical gears and bevel gears, be manufactured in accordance with the present invention; but also that other bodies with toothings, such as spline shafts and worm gears used in plastic material extruders, can be advantageously made.

During the forming process, compression of the material takes place, particularly at the top, on both flanks and at the bottom of dedendums of the teeth, resulting in a high degree of strength of the rolled flanks and the dedendums of the teeth thus produced.

BRIEF DESCRIPTION OF THE DRAWINGS

The invention will be more readily understood with reference to the accompanying drawings in which.

DESCRIPTION OF THE PREFERRED EMBODIMENT

The drawings illustrate the present invention as applied to the manufacture of cylindrical toothed gears which have, for example an involute toothing.

It was found that even in cases under a small load of roll pressure, the sintered material flows at the highest possible rate. The effects of the speed of rotation are significantly greater for sintered materials, than for carbon steels, due to the different structures of the two materials.

Figure 1:
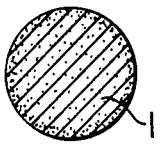
FIG. 1 is a cross-sectional view through a blank made of a suitable sintered material, such blank having been cylindrically formed on its outer surface.

FIG. 1 shows a cross-sectional of a blank 1 in cylindrical form made of a suitable sintered material. The toothing is to be formed into blank 1 by a cold forming process.

The blank 1 is mounted between supporting and centering means such as spindles shown schematically at 8, 9. The longitudinal axis of the blank 1 is, for example, parallel to and in the same plane as the longitudinal axes of the two tools 2 and 3, of which at least one is driven in rotation by a motor (not shown). The tools 2 and 3 are connected together by gears (not shown) for synchronous rotation in the same direction and at the same speed.

Figure 3:
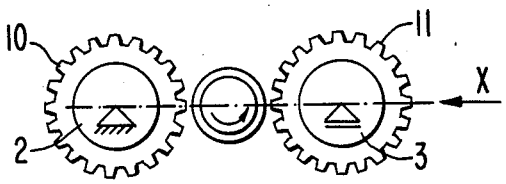
FIG. 3 is an end elevation view of the roll stand or fixture of FIG. 2.
Figure 2:
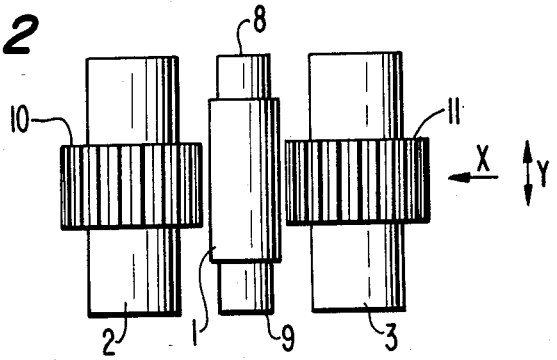
FIG. 2 is a schematic view of a roll stand or fixture for forming the body of FIG. 1.

Tools 2 and 3 are both provided with a suitable profile corresponding to the desired toothing; thus tool 2 is provided with teeth 10 and tool 3 is provided with similar teeth 11. In the construction shown in FIGS. 2 and 3, tool 2 is mounted for rotation about a stationary axis, while tool 3, spindles 8, 9 and blank 1 can be moved by suitable adjusting means (not shown) in direction X (toward tool 2), or Y (vertically in FIG. 3). A hydraulic cylinder (not shown) moves tool 3, which is supported in a carriage (not shown), toward the blank 1 until the profiles on tools 2 and 3 penetrate into the blank 1 and the toothing in the blank is produced by cold forming. The blank 1 is set into rotation by frictional resistance. By this process, it is possible to cold-form the toothing in one operation.

Figure 4:
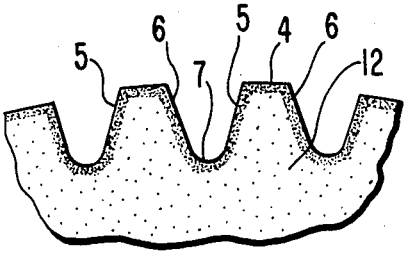
FIG. 4 is a sectional view of a sintered metal body having toothing formed in accordance with the invention, the body being shown on an enlarged scale.

FIG. 4 shows a fragmentary portion of a gear 12 formed in accordance with the present invention. Gear 12 has a plurality of similar regularly and angularly spaced teeth 4, each tooth 4 having opposite flanks 5, 6, with a dedendum 7, between successive teeth.

In accordance with another embodiment of the present invention, the blank 1 can be provided with a pre-toothing by metal forming. The final toothing is then formed as described above.

Although the invention is described and illustrated with reference to the embodiment and drawings described above, it is to be expressly understood that it is in no way limited to the disclosure of such preferred embodiments but is capable of numerous modifications within the scope of the appended claims.

What is claimed is:

1. A sintered metal body with at least one toothing formed by a method, comprising the steps of:
   - sintering a metal blank having an axis;
   - arranging at opposite radial sides of the sintered metal blank two rolling tools provided with teeth extending substantially parallel to the axis of the sintered metal blank;
   - moving at least one of the rolling tools radially towards the other rolling tool and therefore towards the sintered metal blank so that the teeth of the rolling tools penetrate into the sintered metal blank; and
   - rotating said rolling tools in synchronism by means of a gear transmission so that the sintered metal blank is rotated by frictional resistance and a final toothing is formed in the sintered metal blank by cold rolling.

2. A method of forming a sintered metal body with at least one toothing, comprising the steps of:
   - sintering a metal blank having an axis;
   - arranging at opposite radial sides the sintered metal blank two rolling tools provided with teeth freely extending substantially parallel to the axis of the sintered metal blank;
   - moving at least one of the rolling tools radially towards the other rolling tool and therefore towards the sintered metal blank so that the teeth of the rolling tools penetrate into the sintered metal blank; and
   - rotating said rolling tools in synchronism by means of a gear transmission so that the sintered metal blank is rotated by frictional resistance and a final toothing is formed in the sintered metal blank by cold rolling.

3. A method as defined in claim 2, wherein said sintering step includes forming the sintered metal blank with a substantially smooth surface, without a pre-toothing.

4. A method as defined in claim 2, wherein said sintering step includes forming the sintered metal blank with a pre-toothing by metal forming so that the final toothing is formed by cold rolling in the pre-toothed sintered blank.

* * * * *